US007127845B2

(12) United States Patent
Rice et al.

(10) Patent No.: US 7,127,845 B2
(45) Date of Patent: Oct. 31, 2006

(54) PAINTBALL MARKER

(75) Inventors: John Ronald Rice, Staffordshire (GB); Nicholas John Marks, Staffordshire (GB)

(73) Assignee: NPF Limited, Birmingham (GB)

( * ) Notice: Subject to any disclaimer, the term of this patent is extended or adjusted under 35 U.S.C. 154(b) by 0 days.

(21) Appl. No.: 10/248,394

(22) Filed: Jan. 15, 2003

(65) Prior Publication Data

US 2003/0131514 A1 Jul. 17, 2003

(30) Foreign Application Priority Data

Jan. 15, 2002 (GB) ..... 0200810.0

(51) Int. Cl.
*F41A 19/10* (2006.01)

(52) U.S. Cl. ..... 42/69.01

(58) Field of Classification Search ..... 124/31, 124/38, 20.1, 1; 42/69.01, 69.02, 69.03, 42/65; 89/1.42
See application file for complete search history.

(56) References Cited

U.S. PATENT DOCUMENTS

| | | | | | |
|---|---|---|---|---|---|
| 361,100 | A * | 4/1887 | Wesson | 42/65 |
| 2,871,604 | A * | 2/1959 | Norman | 42/69.01 |
| 3,269,045 | A * | 8/1966 | McGaughey | 42/65 |
| 3,548,802 | A * | 12/1970 | Green | 124/70 |
| 3,740,884 | A * | 6/1973 | Wilhelm | 42/17 |
| 4,060,067 | A * | 11/1977 | Dandine | 124/31 |
| 4,667,429 | A * | 5/1987 | Perazzi | 42/69.01 |
| 5,390,653 | A * | 2/1995 | Lee et al. | 124/16 |
| D399,914 | S * | 10/1998 | Walker | D22/108 |
| 5,890,479 | A * | 4/1999 | Morin | 124/31 |
| 5,904,132 | A * | 5/1999 | Biller | 124/22 |
| 5,967,133 | A * | 10/1999 | Gardner, Jr. | 124/77 |
| 6,112,734 | A * | 9/2000 | Kunimoto | 124/73 |
| 6,189,525 | B1 * | 2/2001 | Kutrubes | 124/31 |
| 6,226,915 | B1 * | 5/2001 | Kotsiopoulos | 42/71.02 |
| 6,347,622 | B1 * | 2/2002 | Hsueh | 124/49 |
| 6,439,217 | B1 * | 8/2002 | Shih | 124/77 |
| 6,532,949 | B1 * | 3/2003 | McKendrick | 124/77 |
| 6,550,468 | B1 * | 4/2003 | Tippmann, Jr. | 124/71 |
| 6,553,983 | B1 * | 4/2003 | Li | 124/73 |
| 6,557,542 | B1 * | 5/2003 | Orr | 124/70 |
| 6,561,176 | B1 * | 5/2003 | Fujimoto et al. | 124/76 |
| 6,601,780 | B1 * | 8/2003 | Sheng | 239/337 |
| 6,618,975 | B1 * | 9/2003 | Shih | 42/75.03 |
| 6,705,036 | B1 * | 3/2004 | Orr | 42/69.01 |
| 2003/0079731 | A1 * | 5/2003 | Dobbins | 124/76 |
| 2003/0178018 | A1 * | 9/2003 | Cherry | 124/76 |

FOREIGN PATENT DOCUMENTS

| | | |
|---|---|---|
| WO | WO 87/03081 | 5/1987 |

* cited by examiner

*Primary Examiner*—Troy Chambers

(57) ABSTRACT

A paintball marker comprises a main body 10, a barrel 12 defining a firing axis X-X, and a grip frame assembly including a frame 26 and a trigger 22 pivotably mounted in the frame 26. The trigger has an upper finger engaging portion 50 and a lower finger engaging portion 52 so that it can be operated by two fingers 54, 56. The lower finger engaging portion 52 is curved round so that its finger engaging surface 66 ends in a horizontal part 68. The pivot axis of the trigger is adjustable between a number of positions, one of which is offset to the rear of the finger engaging portions 50, 52 so that the trigger can be operated by pulling downwards on the horizontal part 68 of the finger engaging surface 66.

21 Claims, 7 Drawing Sheets

PAINTBALL MARKER

BACKGROUND OF INVENTION

The present invention relates to paintball markers, also referred to as paintball guns, which are arranged to fire pellets or capsules filled with paint or dye, and are used in paintball games or competitions.

The use of paintball markers differs from the use of real guns. This is partly because the markers are held in different positions from real guns, and indeed may be held in a number of different positions by a single user during a single game or competition. It is also partly because of regulations which determine certain aspects of the firing operation of the markers. In particular paintball markers are generally arranged such that they will only fire one pellet each time that the trigger is depressed. It is therefore desirable to arrange the marker and the trigger so that the trigger can be operated easily, and rapidly, with the marker in a number of different positions. This has lead to the increasing use of two-finger triggers which can be operated by the index and middle fingers of the trigger hand alternately at high speeds so as to achieve a high firing rate. Furthermore, paintball markers are often held in a position close to the user's face so that the trigger hand tends to pull downwards on the trigger rather than backwards. However, for most other positions in which the marker can be held, the trigger is pulled backwards rather than downwards, and it is this type of operation which has determined the design of conventional triggers. The triggers of conventional paintball markers can therefore be difficult or uncomfortable to use in the raised position close to the user's face.

SUMMARY OF INVENTION

The present invention provides a paintball marker comprising a main body and a barrel defining a firing axis, a trigger, and a grip arranged to be held in a hand of a user which operates the trigger, wherein the trigger is movable to fire the marker, and has a finger engaging surface arranged to be pressed by a finger of a user, the finger engaging surface including a vertical part extending substantially perpendicular to the firing axis and a horizontal part extending substantially parallel to the firing axis, such that applying a substantially vertical force to the horizontal part can operate the trigger.

Preferably the application of a substantially horizontal force to the vertical part can also operate the trigger. This gives the user a degree of flexibility in the way that the marker can be used.

Preferably the finger engaging surface is in a curved shape which includes the vertical part and the horizontal part.

Preferably the trigger is arranged to be operated by two fingers, said finger engaging surface being on a lower finger engaging portion arranged to engage one of said fingers and the trigger further comprising an upper finger engaging portion arranged to engage the other of the fingers.

Preferably the trigger has a pivot axis about which it can pivot to fire the marker and the pivot axis is offset horizontally from said horizontal part such that applying a substantially vertical force to the horizontal part can cause the trigger to rotate about the pivot axis. Alternatively the trigger can be arranged to slide rather than pivot, in which case it will generally slide in a straight line, although it could slide in a curved path which would generally form an arc of a circle.

Preferably the substantially horizontal part forms a free end of the trigger.

Preferably the trigger is arranged to be moved in a rearward direction to fire the marker, and the pivot axis is offset to the rear of the horizontal portion. More preferably the pivot axis is offset to the rear of the whole of the finger engaging portion.

Preferably said pivot axis is one of a plurality of selectable pivot axes.

Preferably the trigger includes an actuation portion arranged to apply a force to an actuating mechanism to fire the marker, and said plurality of pivot axes are arranged such that changing between said pivot axes adjusts the lever ratio between at least a part of the finger engaging portion and the actuation portion. This may conveniently be achieved by arranging the pivot axes so that they are offset from each other in the horizontal direction.

Preferably the trigger includes a base portion to which the finger engaging portion and the actuation portion are connected, and the base portion has a plurality of pivot axis defining means spaced along it each of which can be selected to define the operative pivot axis of the trigger.

Preferably the paintball marker has a plurality of further pivot axis defining means arranged to co-operate with those on the trigger to define said plurality of pivot axes. For example, the paintball may include a grip frame which includes the grip and said further pivot axis defining means.

Conveniently the pivot axis defining means and the further pivot axis defining means may define apertures arranged to receive a pin to pivotably support the trigger.

Alternatively the trigger may be arranged to move linearly to fire the marker, for example by sliding.

Preferably the trigger is movably mounted so as to define a direction of motion of the horizontal part which will cause firing of the marker. The direction of motion is preferably at least partially downwards and at a predetermined angle to the horizontal, which may be at least 10°, at least 20°, or at least 25°.

The present invention further provides a trigger for a paintball marker having a firing axis, the trigger having means defining a pivot axis about which it is arranged to pivot in use, and a finger engaging portion arranged to be pressed by a finger of a user, wherein the finger engaging portion includes a vertical part arranged to extend, in use, substantially perpendicular to the firing axis and a horizontal part arranged to extend, in use, substantially parallel to the firing axis, and the pivot axis is offset horizontally from said horizontal part such that applying a vertical force to the horizontal part can cause the trigger to rotate about the pivot point.

Preferably the trigger further comprises a base portion arranged to extend, in use, in a horizontal direction parallel to the firing axis of the marker, the finger engaging portion being connected to the base portion, and an actuation portion connected to the base portion and arranged in use to contact an actuating mechanism of the marker.

Preferably the means defining a pivot axis comprises part of the base portion.

Preferably the base portion has a plurality of pivot axis defining means spaced along it in the horizontal direction.

The present invention still further provides a grip frame and trigger assembly for a paintball marker comprising a trigger according to the invention and a grip frame, the grip frame comprising a grip portion arranged to be held in a hand of a user which operates the trigger, and means defining a pivot axis about which the trigger can rotate.

Preferably the means defining a pivot axis defines a plurality of pivot axes each of which are selectable so as to enable adjustment of the position of the pivot axis. Preferably the grip frame includes an attachment portion for attachment to a paintball marker body, and the attachment portion defines a horizontal direction which is substantially parallel to the horizontal part of the trigger.

The present invention further provides a paintball marker comprising a main body and a barrel defining a firing axis, a trigger, and a grip arranged to be held in a hand of a user which operates the trigger, wherein the trigger is movable to fire the marker, and has a finger engaging surface arranged to be pressed by a finger of the user, the finger engaging surface extends at least partially in a horizontal direction and the trigger is movably mounted so that the finger engaging portion can move in a firing direction to fire the marker, the firing direction being at an angle of at least 10° relative to the horizontal direction. Said direction of motion is more preferably at an angle of at least 20° relative to the horizontal direction, still more preferably at an angle of at least 25° relative to the horizontal direction.

The present invention still further provides a paintball marker comprising a main body, a barrel, a trigger, and a grip arranged to be held in a hand of a user which operates the trigger, and a trigger mounting which defines a pivot axis about which the trigger can be rotated to fire the marker, wherein the trigger mounting is adjustable to adjust the position of the pivot axis.

Preferably the marker includes a mounting part on which the trigger is mounted by means of the trigger mounting, and the trigger mounting is adjustable relative to the mounting part and the trigger whereby adjustment of the pivot axis does not affect the position of the trigger relative to the mounting part. The mounting part can conveniently be formed on a grip frame of the marker.

Preferably the trigger has a plurality of apertures therein and the mounting part has a plurality of apertures therein each associated with a respective one of the apertures in the trigger, and the trigger mounting includes a pin which can be inserted in one of the apertures in the trigger and an associated aperture in the mounting part to select the pivot axis. Preferably the marker defines a horizontal direction and the pivot axes are spaced from each other in a horizontal direction.

The present invention yet further provides a grip frame and trigger assembly for a paintball marker comprising a trigger and a grip frame, and a trigger mounting which defines a pivot axis about which the trigger can be rotated to fire the marker, wherein the trigger mounting is adjustable to adjust the position of the pivot axis. This also provides a degree of flexibility in the angle at which the trigger will move when pulled, and therefore a greater degree of flexibility in a way in which the marker can comfortably and effectively be used.

Preferred embodiments of the invention will now be described by way of example only with reference to the accompanying drawings.

DETAILED DESCRIPTION

Figure 1:
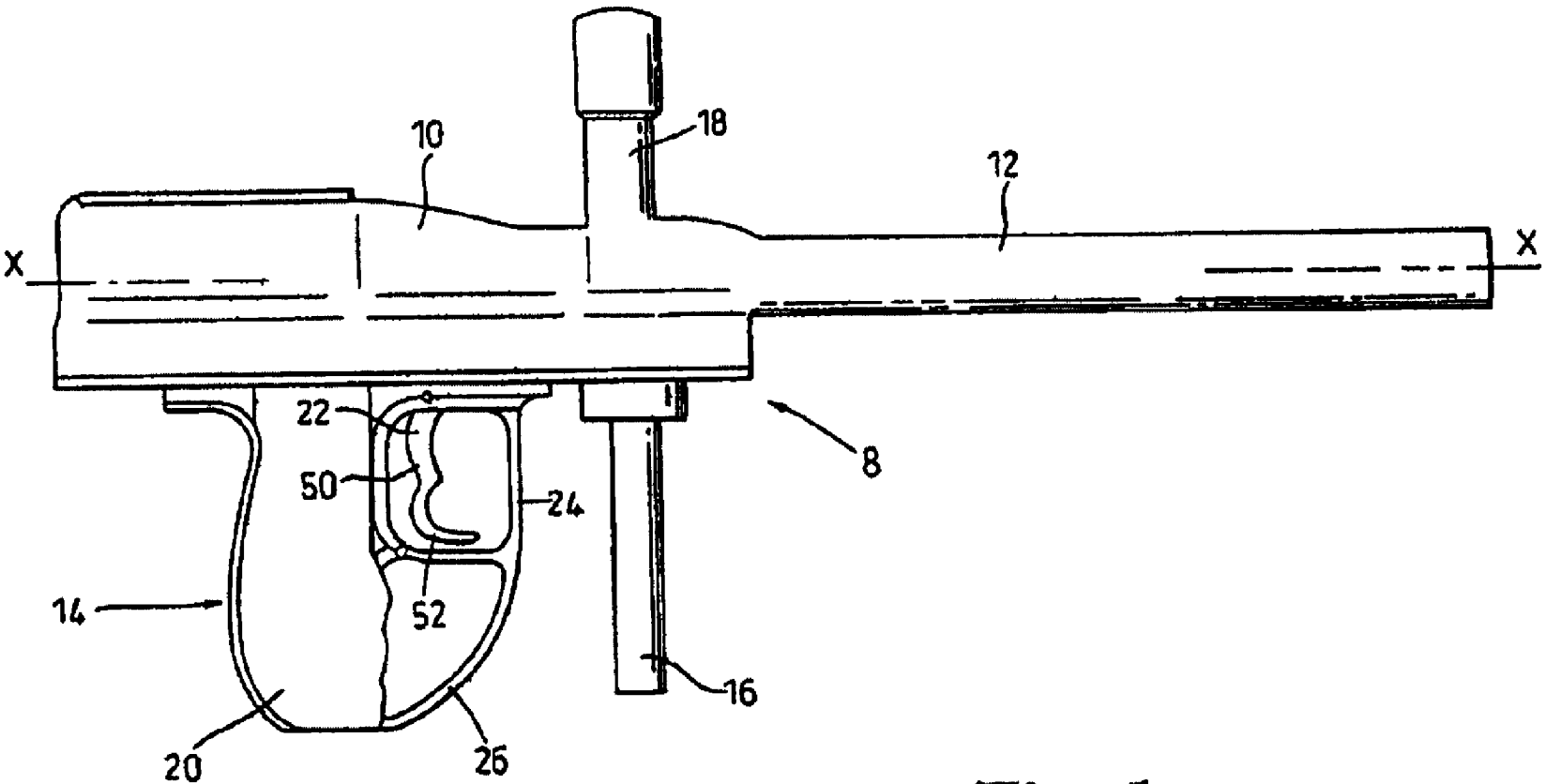
FIG. 1 is a side view of a paintball marker according to the invention.
Figure 2:
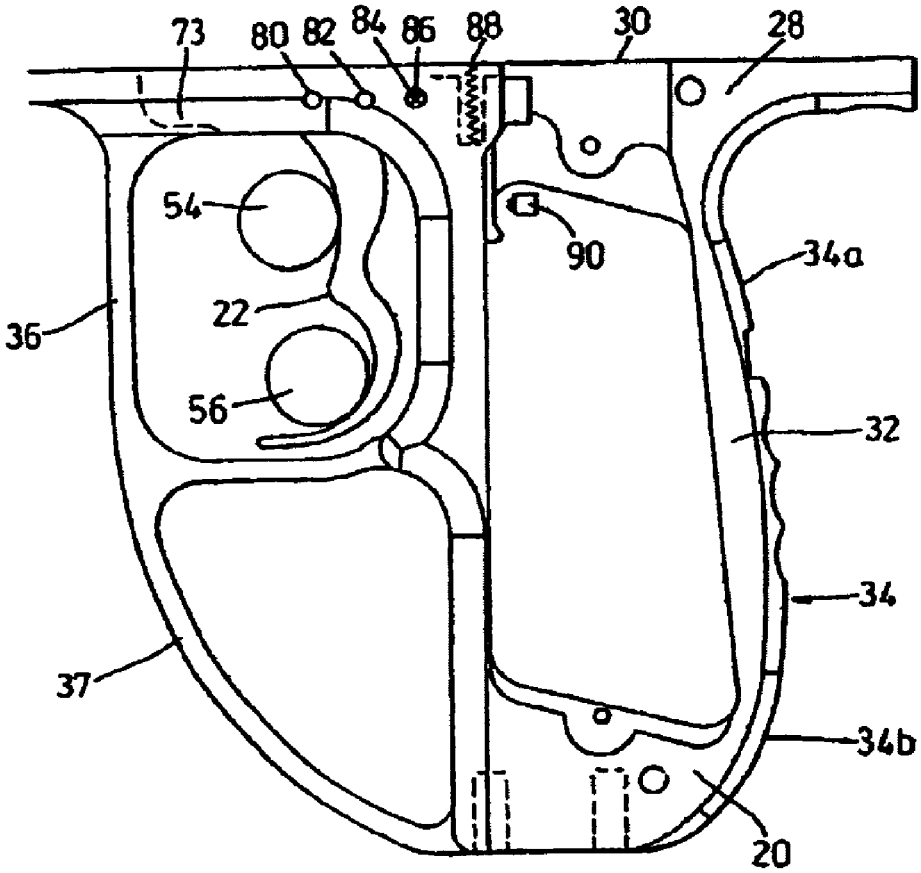
FIG. 2 is a detailed view of a grip frame and trigger assembly forming part of the marker of FIG. 1.
Figure 3:
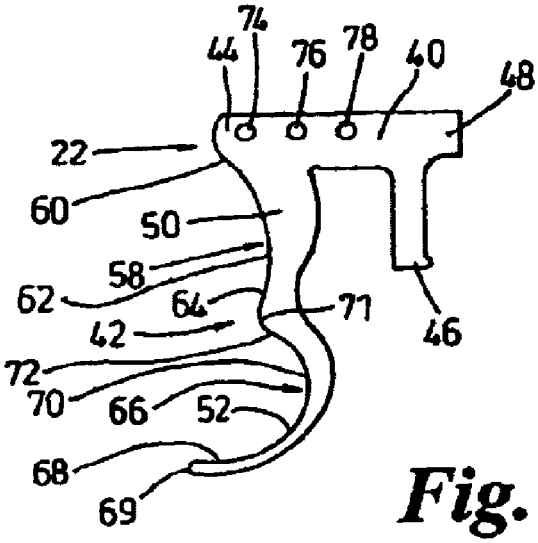
FIG. 3 is a side view of a trigger forming part of the marker of FIG. 1.

Referring to FIGS. 1, 2 and 3, a paintball marker 8 according to the invention comprises a main body 10 and barrel 12, a grip frame assembly 14 attached to the underside of the main body, a propellant port 16 through which propellant in the form of compressed gas is fed to the marker, and a feed port 18 through which die pellets are fed. The main body 10 and barrel 12 define a firing axis X-X along which the pellets are fired. For ease of description the firing axis X-X will be referred to as horizontal and the direction perpendicular to it in the plane of FIG. 1 will be referred to as vertical, as is the case with the marker orientated as shown in FIG. 1, although clearly in use the marker can be held at a number of different angles.

The grip frame assembly 14 is removable as a unit from the main body 10 and includes a grip 20, a trigger 22 and a trigger guard 24. In this embodiment the grip frame is actually made up of a frame 26 which is generally formed of metal such as aluminium, and a grip moulding 27 which is of moulded plastics. The frame 26 is shown in more detail in FIG. 2 and includes a base portion 28 having a generally flat upper surface 30 which rests against the underside of the main body 10, a rear portion 32 which extends downwards from near the rear end of the base portion 28 and forms the rear edge 34 of the grip 20, a guard portion 36 which forms the trigger guard 24, and a cutlass 37 which extends from the lower front corner of the trigger guard 36 to the bottom of the grip 20. As can be seen in FIG. 2, the grip 20 extends downwards substantially perpendicular to the firing axis.

The rear edge 34 of grip 20 is, generally speaking vertical. However it is curved, and has an upper hand supporting portion 34*a* which faces slightly upwards, and a lower hand supporting portion 34*b* which faces slightly downwards.

The trigger 22, as shown in FIG. 3, has a base portion 40, with a finger engaging portion 42 extending downwards from its front end 44 and an actuation portion 46 extending downwards from its rear end 48. The finger engaging portion 42 comprises an upper finger engaging portion 50 and a lower finger engaging portion 52, which are arranged to engage upper and lower trigger fingers 54, 56, which are generally the index finger and middle finger, respectively. The upper finger engaging portion 50 is nearer to the firing axis X-X and to the base portion 40 of the trigger 22 than the lower finger engaging portion 52. The upper finger engaging portion 50 has a front surface 58 which is concavely curved through an arc of about 30°, having an upper section 60 which faces slightly downwards, a middle section 62 which is substantially vertical and faces forwards, and a lower section 64 which faces slightly upwards. The lower finger engaging portion has a front surface 66 which is concavely curved through an angle of about 150°, having a lower end 68, near the free end 69 of the trigger, which is substantially horizontal and faces upwards, a middle section 70 which is substantially vertical and faces forwards, and an upper section 72 which faces slightly downwards. The free end 69 of the trigger therefore forms a horizontally extending tail which extends forwards beyond the cusp 71 between the front surfaces 58, 66 of the upper and lower finger engaging portions 50, 52 of the trigger.

The base portion 40 of the trigger is located within a channel 73 in the base portion 28 of the grip frame, and has three transverse holes 74, 76, 78 through it. Three corresponding pairs of holes 80, 82, 84 are provided through the grip frame base 28 to either side of the channel 73 and a pin 86 is inserted through one of the pairs of holes 80, 82, 84 in the frame and the corresponding one of the holes 74, 76, 78 in the trigger to form a pivot about which the trigger can rotate. The choice of which pair of holes 80, 82, 84 in the frame is used therefore determines the position of the pivot axis of the trigger relative to the frame 26 and the choice of which one of the holes 74, 76, 78 in the trigger is used determines the position of the pivot axis of the trigger relative to the trigger. In this embodiment the position of the trigger 22 relative to the frame 26 is determined by the required position of the actuator portion 46 of the trigger. Therefore for each of the holes 74, 76, 78 in the trigger the size and shape of the trigger 22 and frame 26 dictate that only one corresponding pair of holes 80, 82, 84 in the frame 26 can be used. Adjustment of the pivot axis can therefore be made without altering the position of the trigger 22 itself relative to the frame 26. The holes 74, 76, 78 in the trigger are spaced from each other in the horizontal direction so that the position of the pivot axis of the trigger can be adjusted in the horizontal direction. The frontmost hole 74 is approximately level, in the horizontal direction, with the horizontal portion 68 of the finger engaging surface 66, the middle hole 76 is approximately level with the vertical portion 70 of the finger engaging surface 66, and the rearmost hole 78 is offset to the rear of the horizontal portion 68, and indeed to the rear of the whole of the finger engaging surface 66.

Figure 4:
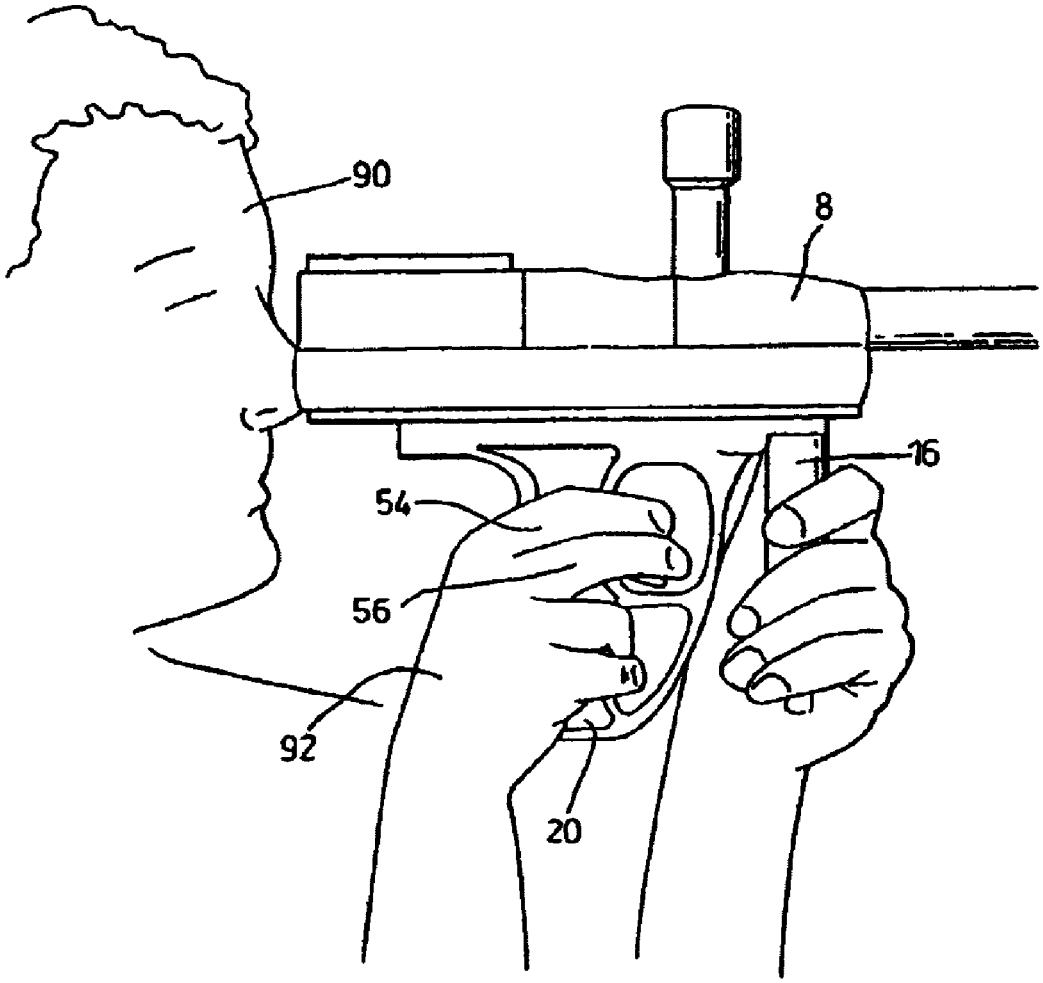
FIG. 4 shows the paintball marker of FIGS. 1 to 3 in use.

The trigger 22 is biased in the forward direction by a spring 88. It is therefore moved backwards against the force of the spring 88, which brings the actuation portion 46 into contact with a microswitch 90 located in the grip 20 which activates the firing mechanism to fire the marker, and the spring 88 returns it to its original position when it is released. During use, the paintball marker 8 can be held in a variety of positions. Referring to FIG. 4, the gas port 16 can be used as a support and is held in one hand, while the other hand acts as the trigger hand and holds the grip 20 with the index and middle fingers 54, 56 on the upper and lower finger engaging portions 50, 52 of the trigger. If the marker 8 is being held close to the face 90 as shown in FIG. 4, then the palm of the trigger hand 92 rests against the lower part 34*b* of the rear surface of the grip 20, and, provided it is low enough down, facing slightly upwards. If the marker 8 is held further away from the user, the forearm becomes more horizontal and the palm of the trigger hand 92 moves up the grip 20 so that the palm rests on the upper part 34*a* of its rear edge 34, facing slightly downwards. Because of the curved shape of the rear surface 34 of the grip 20, the trigger hand 92 can move through a range of positions by moving vertically up and down the grip 20, and the direction in which the palm will be facing will change accordingly. When the trigger is pulled, the fingers 54, 56 tend to pull it towards the palm of the hand, and therefore the direction of the force applied to the trigger 22 by each of the trigger actuating fingers 54, 56 will vary, as will their position on the trigger. In some circumstances it is desirable to be able to move the trigger hand 92 even further down than is shown in FIG. 4 so that the palm is facing substantially upwards. In this case the natural direction for the fingers 54, 56 to pull the trigger 22 is substantially downwards, i.e. perpendicular to the firing axis.

Referring now to FIGS. 5*a* to 5*i*, the various positions and directions of the force which a user can apply to the trigger to fire the marker will now be described. In these figures three pivot axes A, B and C are shown which correspond to the pin 86 being located in the foremost 74, middle 76 and rearmost 78 hole in the trigger, and the corresponding holes 80, 82, 84 in the frame 26, respectively.

Figure 5A:
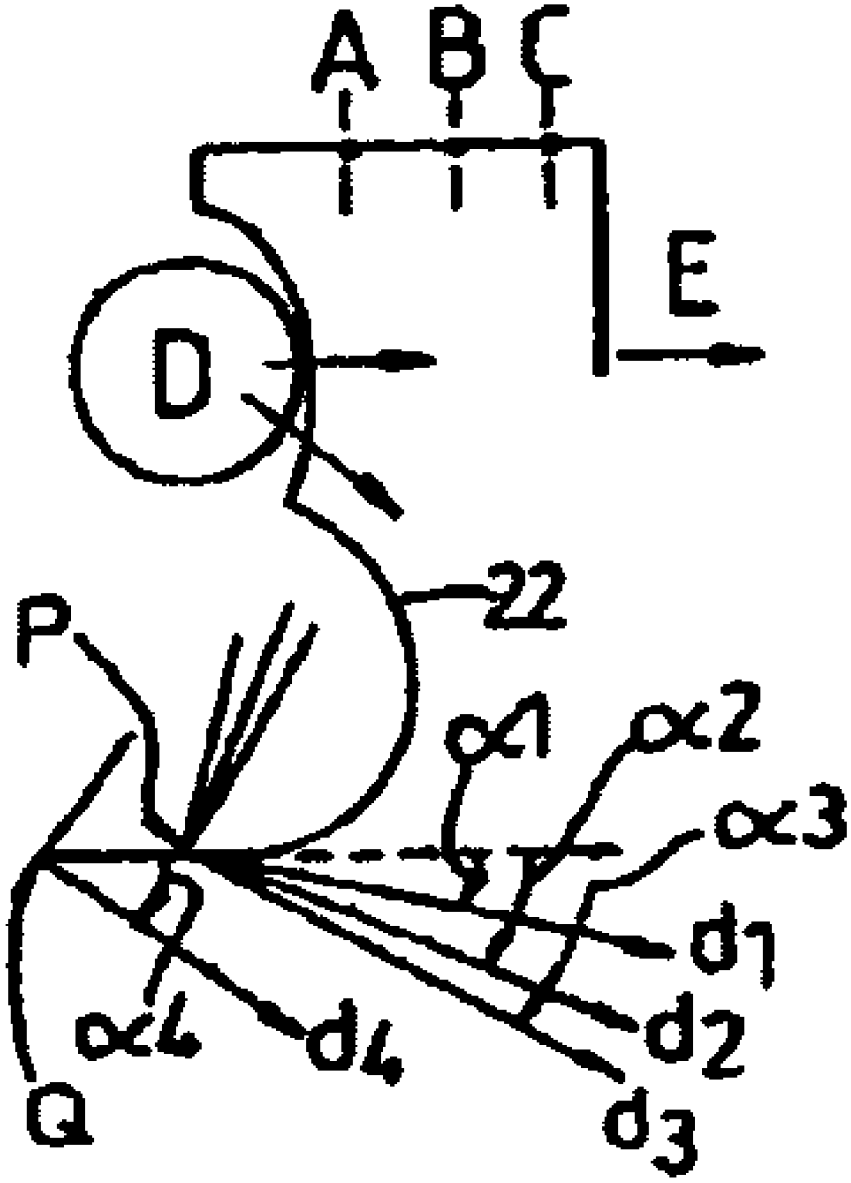
FIGS. 5*a*, 5*b*, 5*c*, 5*d*, Se, 5*f*, 5*g*, 5*h* and 5*i* are diagrams showing the effects of forces applied in various positions and directions to the trigger of the marker of FIGS. 1 to 3.

Referring to FIG. 5*a*, the direction of movement of the trigger 22 when it is pulled is in an arc around whichever pivot axis A, B, C is being used. For any point on the trigger, such as point P in the middle of the lower end 68 of the trigger 22, the direction of movement will be in an arc around the pivot axis A, B, C, i.e. perpendicular to the radial line from the pivot axis A, B, C to that point P. As shown in FIG. 5*a*, of the front pivot axis A is used, the point P will move in direction $d_1$, if the middle pivot axis B is used, the point P will move in the direction $d_2$, and if the rear pivot axis C is used, the point P will move in the direction $d_3$. These directions $d_1$, $d_2$, $d_3$ are at different angles $\alpha_1$, $\alpha_2$, $\alpha_3$ to the horizontal. It will be appreciated that, the greater the angle $\alpha$, the closer to vertical is the movement of the point P on the trigger, and the more easily the trigger can be actuated by pulling vertically downwards on it. Pure vertical downward movement of the point P would correspond to an angle $\alpha$ of 90°. Clearly, the angle $\alpha_3$ is the greatest out of $\alpha_1$, $\alpha_2$ and $\alpha_3$, and use of the rear pivot point C, which is offset the furthest to the to the rear of the point P, allows the trigger to be operated most easily by pulling vertically downwards at the point P. It will further be appreciated that, if the very end Q of the trigger 22 is used, the corresponding direction of travel of that point Q if the rear pivot axis C is used is in the direction $d_4$ which is at an angle $\alpha_4$ to the horizontal. This angle $\alpha_4$ is larger than the angle $\alpha_3$ as movement of the point Q is nearer to vertical than movement of point P. This is because the point Q is further offset horizontally from the axis C than is the point P. In this example, $\alpha_1$ is about 10°, $\alpha_2$ is about 20°, $\alpha_3$ is about 25°, and $\alpha_4$ is about 35°. It will therefore be appreciated that adjustment of the pivot axis position A, B, C adjusts the direction in which the finger engaging portions 50, 52 of the trigger 22 will move when the trigger 22 is pulled to fire the marker.

Figure 5B:
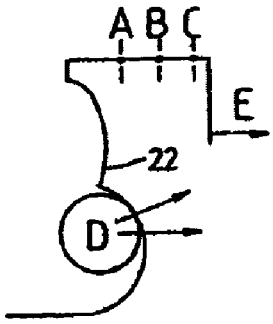
Figure 5C:
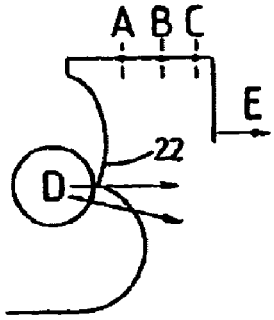
Figure 5D:
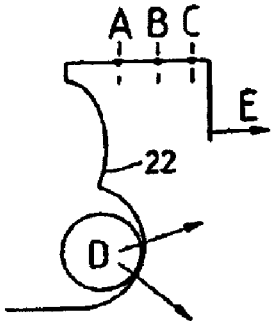

With the hand at the top of the grip 20, i.e. when the marker 8 is held away from the body, the index finger 54 will generally be in the position shown in FIG. 5*a*, pulling horizontally backwards or slightly downwards on the upper finger engaging portion 50 of the trigger 22, and the middle finger 56 will be in the position shown in FIG. 5*b*, pulling horizontally backwards or slightly upwards on the lower finger engaging portion 52 of the trigger 22. In this position the forwardmost pivot axis A will give the most comfortable trigger action because, as it is positioned substantially vertically above the front surfaces of both the upper and lower finger engaging portions 50, 52 of the trigger, the trigger will move in a substantially rearward direction when pivoting. If the middle pivot axis B is used the trigger will rotate downwards when pulled back, which makes it slightly less comfortable, and if the rearmost pivot axis C is used, the downward movement is even more pronounced. With the hand moved slightly down the grip 20, the index finger 54 will tend to move down the trigger so that it rests on the bottom of the upper finger engaging portion 50, near the cusp 71 where it joins the lower finger engaging portion 51, as shown in FIG. 5*c*. The middle finger 56 will move down the lower finger engaging portion 52 as shown in FIG. 5*d*.

In these positions both of the fingers 54, 56 can pull backwards or slightly downwards towards the palm of the hand. With the hand in this position it is also possible for the player to rest his fingers on the cusp 71 and the very bottom tip of the free end 69 of the trigger as shown in FIG. 5*g*. Here the fingers can pull backwards and downwards on the trigger.

Figure 5E:
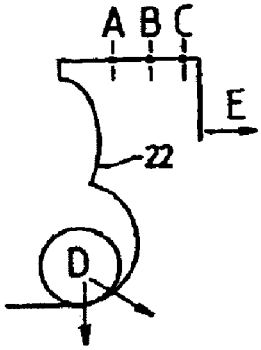
Figure 5F:
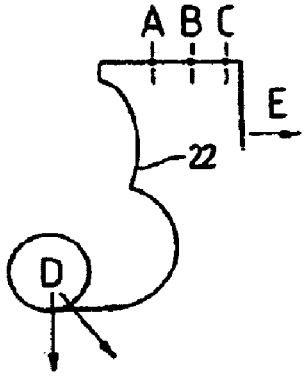
Figure 5G:
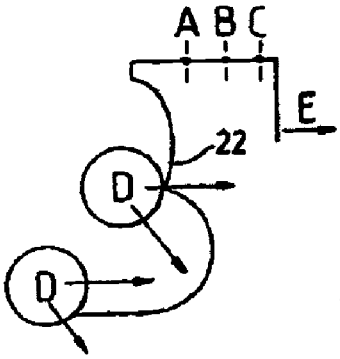

If the hand is moved even further round the grip so that the palm is facing substantially upwards, then either one, or both, of the index and middle fingers 54, 56 can be placed on the horizontal part 68 of the surface of the lower portion 52 of the trigger, in the positions shown in FIGS. 5*e* and 5*f*. In these positions both of the fingers 54, 56 can pull substantially downwards on the trigger 22 to fire the marker.

Figure 5H:
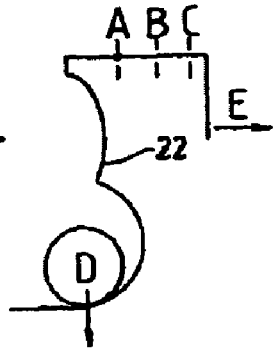
Figure 5I:
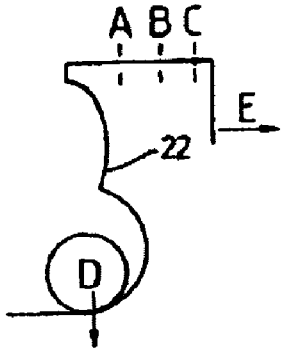

Referring to FIGS. 5*h* and 5*i*, when the trigger is being operated by applying a force downwards on the horizontal part 68 of the trigger, the choice of pivot axis A, B, C will affect the lever ratio between the finger engaging portion 42 of the trigger and the actuation portion 46. The lever ratio here is defined as the ratio of vertical movement of the trigger finger to the resulting horizontal movement of the actuating portion 46 at the point where it contacts the microswitch 90. If the rearmost pivot axis C is used as shown in FIG. 5*i*, the lever ratio will be reasonably high. However as the pivot axis is moved forwards towards the front position A as shown in FIG. 5*h*, the lever ratio decreases, and the force that will need to be applied downwards to the trigger to fire the marker will increase. This is because the angle at which the horizontal part 68 of the trigger will need to be moved changes, approaching horizontal. If the finger is towards the rear of the horizontal part 68 of the trigger, it may be very difficult to operate the trigger by pulling directly downwards.

Therefore the player can select the pivot axis of the trigger 22 to be in any of the positions A, B or C to suit his intended style of play. If he expects to use the marker 8 in the more conventional manner with his hand on the back of the grip 20, then he might select the frontmost pivot axis A. If he expects to be using the gun with his trigger hand very low down on the underside of the grip 20, he might select the rearmost pivot axis C. If he will use a variety of hand positions he may prefer to use the middle pivot axis B.

Because the finger engaging surface 66 of the lower portion 52 of the trigger curves through less than 180° the middle finger 56 of the user's trigger hand can easily be brought into contact with the trigger. Also the middle finger 56 can easily be lifted off the trigger and then replaced on it at high speed, alternating with the index finger on the upper portion 50, thus enabling a rapid firing rate. If both index and middle fingers 54, 56 are used on the lower portion 52 of the trigger, then they can both be lifted off it easily in the same way.

Figure 6:
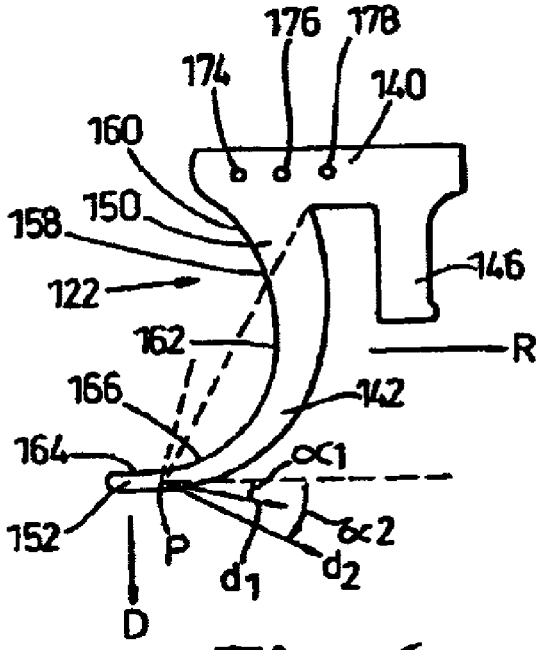
FIG. 6 is a side view of a trigger for use in a marker according to a second embodiment of the invention.

Referring to FIG. 6, in a second embodiment of the invention, the trigger 122 has its finger engaging portion 142 formed in a single continuous curved shape, having an upper finger engaging portion 150 which is arranged to be pulled in the rearward direction to fire the marker, and a lower finger engaging portion 152 arranged to be pulled in the downward direction to fire the marker. The upper finger engaging portion 142 has a front surface 158 and the lower finger engaging portion 152 has an upper surface 166. These two front surfaces form a continuous curved finger engaging surface 158, 166 which has an upper portion 160 which faces slightly downwards, a middle portion 162 which faces horizontally to the front, and a lower portion 164 which faces substantially upwards. The trigger 122 also comprises a base portion 140 and an actuation portion 146. The base portion 140 has front 174, middle 176 and rear 178 pivot holes through it which define three respective pivot points.

The trigger 122 is large enough for a user to place two fingers on it, one above the other, and the smooth curve of the front surface 160, 162, 164 allows the fingers to be moved round the trigger and used in a number of positions. The trigger can be pulled to fire the gun by pulling the rearward direction R on the upper portion 150, by pulling in the downward direction D on the lower portion 152, or by pulling in directions downwards and to the rear on either the upper 150 or lower 152 portion. As with the first embodiment, using the rearmost pivot aperture 178 will allow the trigger to move more in a downward direction, and using the foremost pivot aperture 174 will allow the trigger 122 to move in a more rearward direction. The pivot point 174, 176, 178 can be selected depending on the position in which the marker is to be used. If the foremost pivot point 174 is used, then the point P on the horizontal lower portion 152 of the trigger will move in direction $d_1$ to fire the marker. This direction is at an angle $\alpha_1$ to the horizontal which in this case is about 12°. If the rearmost pivot point 178 is used, then the same point P moves in the direction $d_2$ to fire the marker, which is at an angle $\alpha_2$ of about 25° to the horizontal. Therefore, while the trigger can be operated by pulling vertically downwards at the point P with any of the pivot positions 174, 176, 178, this will be easiest with the rearmost one 178.

Figure 7:
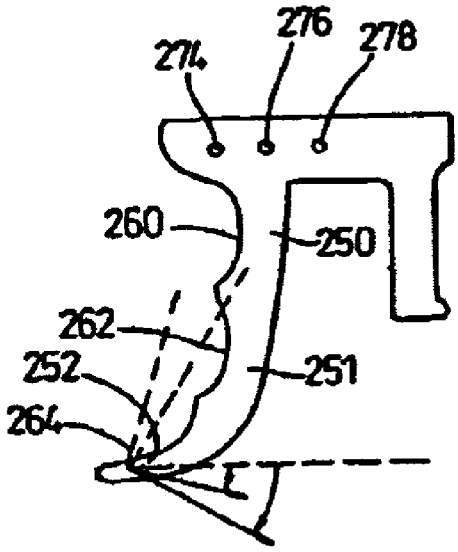
FIG. 7 is a side view of a trigger for use in a marker according to a third embodiment of the invention.

Referring to FIG. 7, in a third embodiment a trigger 222 includes a finger engaging portion 242 which is in three sections: an upper finger engaging portion 250, a middle finger engaging portion 251 and a lower finger engaging portion 152. The front surfaces 260, 262, 264 of these portions 250, 251, 252 are each formed as a concave curve, the upper and middle ones 260, 262 facing substantially forwards and slightly upwards, and the lower one 264 facing substantially upwards. With this design, the user has the option of placing his two fingers on the upper and middle finger engaging portions 250, 251, or the middle and lower finger engaging portions 251, 252. The trigger can be actuated to fire the marker by pulling substantially in the rearward direction on the upper and middle finger engaging portions 250, 251, or substantially downwards on the lower finger engaging portion 252. As in the previous two embodiments, three pivot apertures 274, 276, 278 are provided to allow adjustment of the trigger action.

Again, if the user is pressing on the lower portion 252 of the trigger at point P, the direction of travel will be in direction $d_1$ if the front pivot point 274 is used, and in direction $d_2$ if the rear pivot point 278 is used. These are similar to the corresponding directions in the embodiment of FIG. 6, and are at similar angles $\alpha_1$, $\alpha_2$ to the horizontal.

Figure 8:
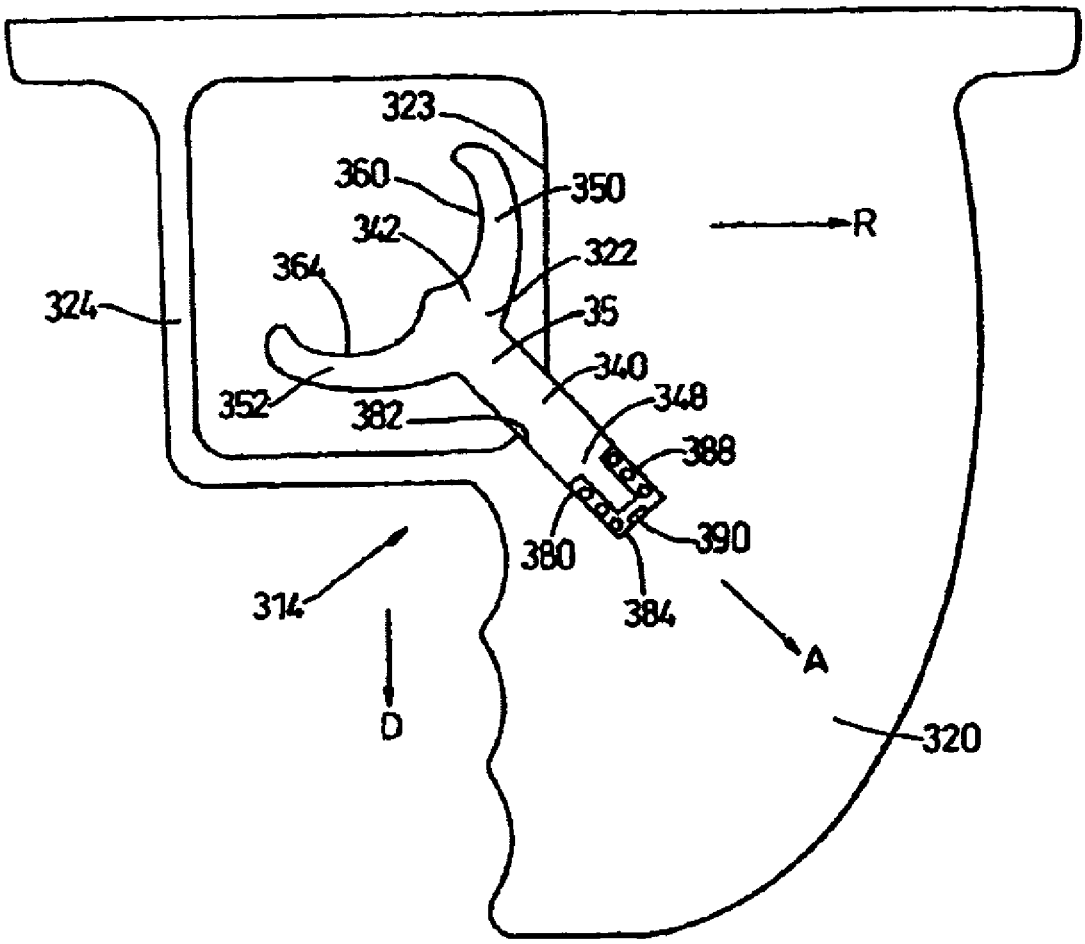
FIG. 8 is a side view of a grip frame assembly for use in a marker according to a fourth embodiment of the invention.

Referring to FIG. 8, in a fourth embodiment of the invention a grip frame assembly 314, which can be used in place of the grip frame assembly 14 of FIG. 1, includes a grip 320 and a trigger guard 324, and a trigger 322. The trigger 322 includes a finger engaging portion 342 and a support shaft 340. The grip 320 has a bore 380 formed in it which has an open end 382 in the front surface 323 of the grip 320 and extends downwards and to the rear into the grip 320 at an angle of about 45° relative to the vertical plane. The trigger support shaft 340 is a sliding fit in the bore 321. A coil spring 388 acts between the bottom end 348 of the support shaft 340 and the bottom 384 of the bore 380 to hold them apart, and a microswitch 390 is located in the bottom 384 of the bore 321. In the absence of any force on the trigger 322, the spring 388 holds the shaft 340 just clear of the microswitch 390, but if the trigger is pressed into the bore 321, the microswitch detects this and causes the marker to fire.

The finger engaging portion 342 of the trigger 322 has an upper portion 350 extending upwards from the upper end 351 of the shaft 340 and a lower portion 352 extending forward from the upper end 351 of the shaft 340. The upper portion 350 has a concavely curved front face 360 which faces substantially forwards, and the lower portion 352 has a concavely curved upper surface 364 which faces substantially vertically upwards.

As each of the two front faces 360, 364 are curved, forces can be applied to each of them in a range of directions, from substantially horizontal and to the rear, as indicated by arrow R, to substantially vertically downwards, as indicated by arrow D. If a force in any of this range of directions is applied to the trigger 322, it will move in the direction of the arrow A down the bore 380, i.e. backwards and downwards at about 45° relative to both the horizontal and the vertical planes. Therefore the marker can be fired by applying a force on the trigger in any of this range of directions.

The invention claimed is:

1. A paintball marker which defines a horizontal direction and is comprised of a main body, a barrel, a trigger, and a grip arranged to be held in a hand of a user which operates the trigger, and a trigger mounting mechanism which is adjustable in the horizontal direction and which defines a pivot axis about which the trigger can be rotated to fire the paintball marker wherein the trigger mounting mechanism is adjustable to adjust the position of the pivot axis.

2. A paintball marker according to claim 1 including a mounting part on which the trigger is mounted by means of the trigger mounting mechanism, and the trigger mounting mechanism is adjustable relative to the mounting part and the trigger whereby adjustment of the pivot axis does not affect the position of the trigger relative to the mounting part.

3. A paintball marker according to claim 2 including a grip frame which includes the mounting part.

4. A paintball marker according to claim 2 wherein the trigger has a plurality of apertures therein and the mounting part has a plurality of apertures therein each associated with a respective one of the apertures in the trigger, and the trigger mounting mechanism includes a pin which can be inserted in one of the apertures in the trigger and an associated aperture in the mounting part to select the pivot axis.

5. A paintball marker according to claim 1 wherein the trigger has a finger engaging surface and the pivot axis is offset to the rear of the whole of the finger engaging surface.

6. A paintball marker comprising a main body and a barrel defining a firing axis, a trigger and a grip arranged to be held in a hand of a user which operates the trigger, wherein the trigger is movable to fire the paintball marker, and has a finger engaging surface arranged to be pressed by a finger of the user, the finger engaging surface including a vertical part extending substantially perpendicular to the firing axis and a horizontal part extending substantially parallel to the firing axis, whereby application of a substantially vertical force to the horizontal part can operate the trigger, wherein the trigger has a pivot axis about which it can pivot along a pivot path to fire the paintball marker and the pivot axis is offset horizontally from the horizontal part along the entire pivot path whereby the application of a substantially vertical force to the horizontal part can cause the trigger to rotate about the pivot axis, wherein the trigger has a plurality of selectable pivot axes selectable from foremost to rearmost, relative to the horizontal part of the finger engaging surface.

7. A paintball marker according to claim 6 wherein the paintball marker includes an actuating mechanism, the trigger includes an actuation portion arranged to apply a force to the actuating mechanism to fire the paintball marker, and a lever ratio, the lever ratio being the ratio of vertical movement of the finger engaging portion relative to the horizontal movement of the actuation portion, and the plurality of pivot axes are arranged such that changing between the pivot axes adjusts the lever ratio between at least a part of the finger engaging portion and the actuation portion.

8. A paintball marker according to claim 6 wherein the pivot axes are offset from each other in the horizontal direction.

9. A paintball marker according to claim 8 wherein the trigger includes a base portion to which the finger engaging portion and the actuation portion are connected, and the base portion has a plurality of pivot axis defining means for defining the operative pivot axis of the trigger, the plurality of pivot axis defining means being spaced along the base portion, each of the plurality of pivot axis defining means being selectable to define the operative pivot axis of the trigger.

10. A paintball marker according to claim 9 having a plurality of further pivot axis defining means for defining the operative pivot axis of the trigger arranged to co-operate with those on the trigger to define the plurality of pivot axes.

11. A paintball marker according to claim 10 including a grip frame which includes the grip and the further pivot axis defining means for defining the operative pivot axis of the trigger.

12. A paintball marker according to claim 10 wherein the pivot axis defining means for defining the operative pivot axis of the trigger and the further pivot axis defining means for defining the operative pivot axis of the trigger define apertures arranged to receive a pin to pivotably support the trigger.

13. A paintball marker comprising a main body and a barrel defining a firing axis, a trigger, and a grip arranged to be held in a hand of a user which operates the trigger, a paintball marker wherein the paintball marker defines a horizontal direction and the trigger mounting mechanism is adjustable in the horizontal direction, and the trigger is movable to fire the paintball marker, and has a finger engaging surface arranged to be pressed by a finger of the user, the finger engaging surface including a vertical part extending substantially perpendicular to the firing axis and a horizontal part extending substantially parallel to the firing axis, whereby application of a substantially vertical force to the horizontal part can operate the trigger, wherein the trigger has a pivot axis about which it can pivot to fire the paintball marker and the pivot axis is offset horizontally from the horizontal part whereby the application of a substantially vertical force to the horizontal part can cause the trigger to rotate about the pivot axis, and wherein the trigger has a plurality of selectable pivot axes and the pivot axis is one of the plurality of pivot axes, wherein the pivot axes are offset from each other in the horizontal direction and to the rear of the finger engaging surface.

14. A paintball marker comprising a main body and a barrel defining a firing axis, a trigger, and a grip arranged to be held in a hand of a user which operates the trigger, wherein the trigger is movable to fire the paintball marker, and has a finger engaging surface arranged to be pressed by a finger of the user, the finger engaging surface including a vertical part extending substantially perpendicular to the firing axis and a horizontal part extending substantially parallel to the firing axis, whereby application of a substantially vertical force to the horizontal part can operate the trigger, wherein the trigger has a pivot axis about which it can pivot to fire the paintball marker and the pivot axis is offset horizontally from the horizontal part whereby the application of a substantially vertical force to the horizontal part can cause the trigger to rotate about the pivot axis, and wherein the trigger has a plurality of selectable pivot axes and the pivot axis is one of the plurality of pivot axes, wherein the trigger includes a base portion to which the finger engaging portion and the actuation portion are connected, and the base portion has a plurality of pivot axis defining means for defining the operative pivot axis of the trigger, the plurality of pivot axis defining means being spaced along the base portion, each of the plurality of pivot axis defining means being selectable to define the operative pivot axis of the trigger and said pivot axes are to the rear of the finger engaging surface.

15. A paintball marker according to claim 14 wherein the trigger is movably mounted so as to define a direction of motion of the horizontal part which will cause firing of the marker, and said substantially vertical force to the horizontal part is at least partially downwards and at a predetermined angle relative to the horizontal part.

16. A paintball marker according to claim 15 wherein the direction of motion is at an angle of at least 10° relative to the horizontal part.

17. A paintball marker according to claim 15 wherein the direction of motion is at an angle of at least 20° relative to the horizontal part.

18. A paintball marker according to claim 15 wherein the direction of motion is at an angle of at least 25° relative to the horizontal part.

19. A paintball marker according to claim 14 having a plurality of further pivot defining means for defining the operative pivot axis of the trigger arranged to co-operate with those on the trigger to define the plurality of pivot axes.

20. A paintball marker according to claim 19 including a grip frame which includes the grip and the further pivot axis defining means for defining the operative pivot axis of the trigger.

21. A paintball marker according to claim 19 wherein the pivot axis defining means for defining the operative pivot axis of the trigger and the further pivot axis defining means for defining the operative pivot axis of the trigger define apertures arranged to receive a pin to pivotably support the trigger.

* * * * *